US008595898B2

(12) United States Patent
Smith

(10) Patent No.: US 8,595,898 B2
(45) Date of Patent: Dec. 3, 2013

(54) SELF-CLOSING SLIDING DOOR ASSEMBLY

(75) Inventor: Gary R. Smith, Hatfield, PA (US)

(73) Assignee: Overhead Door Corporation, Lewisville, TX (US)

( * ) Notice: Subject to any disclaimer, the term of this patent is extended or adjusted under 35 U.S.C. 154(b) by 0 days.

(21) Appl. No.: 13/189,081

(22) Filed: Jul. 22, 2011

(65) Prior Publication Data

US 2013/0019432 A1 Jan. 24, 2013

(51) Int. Cl.
*E05F 1/10* (2006.01)

(52) U.S. Cl.
USPC ..... 16/78; 16/63; 16/61

(58) Field of Classification Search
USPC ..... 16/63, 64, 75–78, 193, 197, 198; 49/379, 360, 381, 386, 394, 404, 405, 49/449; 160/191, 192, 290.1, 322
See application file for complete search history.

(56) References Cited

U.S. PATENT DOCUMENTS 3,020,580 A * 2/1962 Glenn ..... 16/61
3,480,227 A * 11/1969 Matthews ..... 242/381
4,330,960 A * 5/1982 Hasemann et al. ..... 49/404
4,675,938 A * 6/1987 Bundschuh ..... 16/63
4,935,987 A * 6/1990 Sterner, Jr. ..... 16/198
5,052,151 A * 10/1991 Inui ..... 49/394
5,513,469 A * 5/1996 Tajudeen et al. ..... 49/404
5,531,257 A * 7/1996 Kuhar ..... 160/168.1 P
5,937,478 A * 8/1999 Regnier ..... 16/78
6,021,607 A * 2/2000 Angove ..... 49/404
6,318,661 B1 * 11/2001 Martin et al. ..... 242/373
6,957,683 B2 * 10/2005 Toti ..... 160/170
7,124,469 B2 * 10/2006 Tsekhanovsky et al. ..... 16/79

* cited by examiner

*Primary Examiner* — Chuck Mah
(74) *Attorney, Agent, or Firm* — Gardere Wynne Sewell LLP

(57) ABSTRACT

Disclosed is a self-closing sliding door assembly operable to allow manual opening and controlled automatic closing of a sliding door. The door assembly comprises storage spools for storing biasing members biased in a wound position around the storage spools. The door assembly further comprises a main spool for winding a cable and the biasing members. When the door is moved towards an open position, the cable is unwound from the main spool, causing the spool to rotate in a first direction. When the main spool is rotated in the first direction, the biasing members are wound onto the main spool and store energy operable to generate a force to cause the main spool to rotate in a second direction. When the door is released, the energy stored in the biasing members rotates the main spool in the second direction, thereby winding the door cable and providing a sufficient force to move the door towards the closed position.

20 Claims, 5 Drawing Sheets

SELF-CLOSING SLIDING DOOR ASSEMBLY

BACKGROUND

1. Technical Field

The present invention relates to door closing systems and, more particularly, to a self closing system for controlling the closing movement of a sliding door.

2. Introduction

Conventional sliding door systems typically include one or more sliding doors mounted in a track directing movement of the sliding doors between open and closed positions, wherein such door systems may be manually or automatically operated. Manually operated door systems tend to be inefficient and slow as they require a user to move the door between both open and closed positions. In settings requiring quick, efficient door operation such as, for example, in a medical facility, manually operated sliding doors may be impractical.

Automatically operated sliding door systems may address some of the deficiencies of manually operated sliding door systems; however, automatic door systems provide several drawbacks as well. For example, automatic door systems typically provide a fixed timing and range of motion of the sliding doors. The fixed timing of the doors may be undesirable as operation of the door may be premature, too slow, or otherwise disruptive. The fixed range of motion of the sliding door may be undesirable if a user wishes to allow for a specific amount of clearance as they pass through the open doorway. Additionally, manual and automatic sliding door systems tend to experience other disadvantages such as, for example, slamming of the door against the door jamb and oftentimes require a large mounting space. As such, conventional sliding door systems may not be satisfactory for all conditions of operation.

SUMMARY

In one embodiment, a self-closing sliding door assembly is illustrated being operable between an open position and a closed position, the assembly comprising a main spool disposed on a first shaft, a storage spool disposed on a second shaft and a biasing member storable on the storage spool and coupled to the main spool at one end. In response to moving the door to the open position, the biasing member unwinds from the storage spool and wraps around the main spool to store potential energy in the biasing member. When the door is released, the potential energy exerts a closing force on the door to move the door to the closed position.

In another embodiment, a self-closing sliding door assembly is operable to control movement of a door between a first position and a second position. The sliding door assembly includes an output spool and cable reel disposed on a first shaft, a storage spool disposed on a second shaft, and a biasing member storable on the storage spool and having an end coupled to the output spool. In operation, movement of the door in a first direction unwinds a door cable from the cable reel thereby causing rotation of output spool to unwind the biasing member from the storage spool onto the output spool. This unwinding generates stored potential energy in the biasing member sufficient such that when the door is released (i.e., no longer moved in the first direction), the biasing member generates a closing force in order to retract and wrap around the storage spool, which rotates the output spool in an opposite direction. Accordingly, as the output spool rotates in this opposite direction, the cable reel rotates therewith thereby winding the cable thereon to pull the door in the second and opposite direction. The present system is compact (i.e., contains a low profile) to fit within existing header assemblies.

The foregoing and other features, as well as the advantages thereof, will become further apparent from the following detailed description of one or more embodiments of the invention, read in conjunction with the accompanying drawings, in which:

DETAILED DESCRIPTION OF THE DRAWINGS

Figure 1:
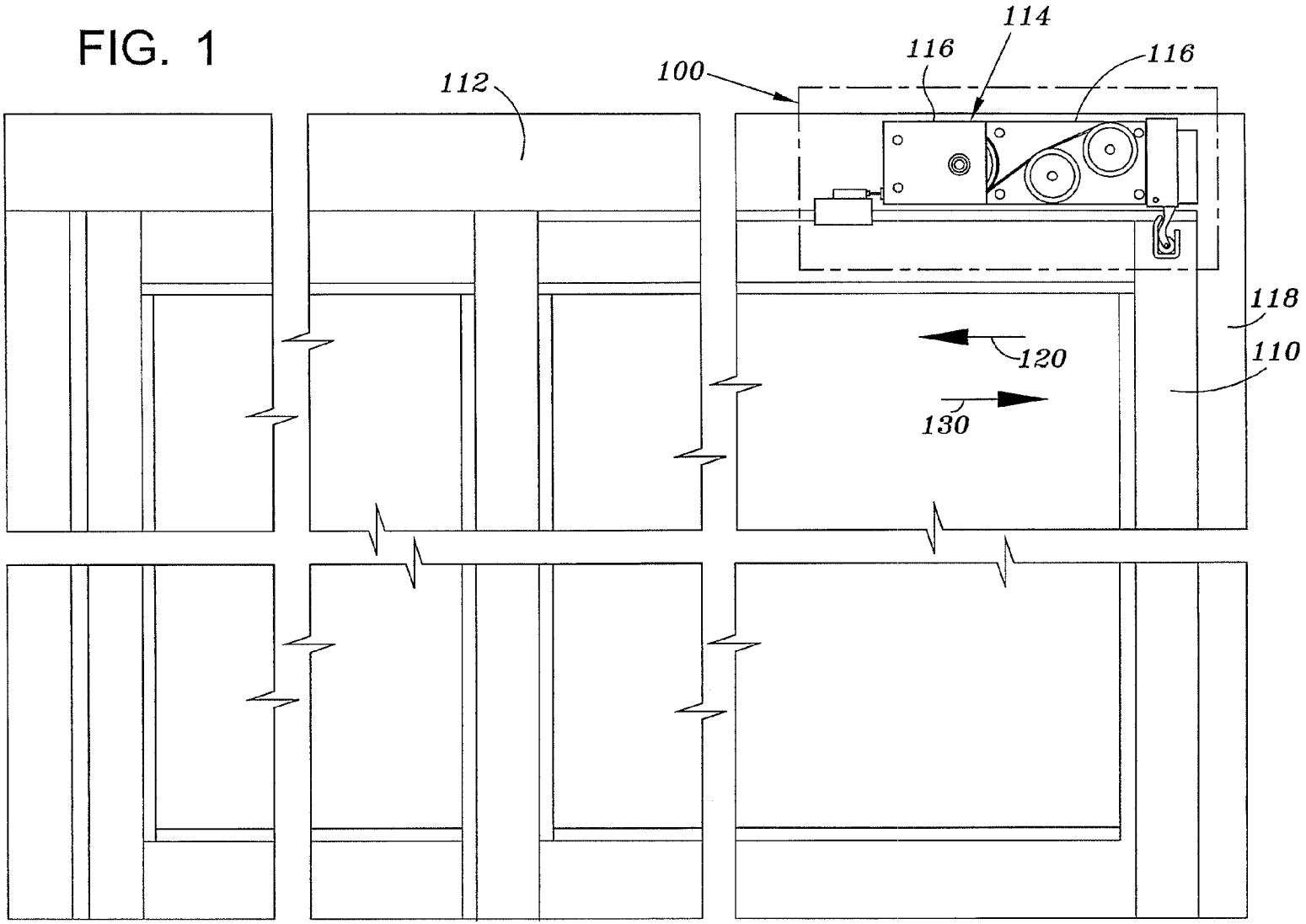
FIG. 1 illustrates a first embodiment of the self closing sliding door assembly.

In the description that follows, like parts are marked throughout the specification and drawings with the same reference numerals, respectively. The drawings are not necessarily to scale and certain features may be shown exaggerated in scale or in somewhat schematic form in the interest of clarity and conciseness.

Referring to FIG. 1, a self-closing sliding door assembly 100 is illustrated for controlling movement of a door 110 from an open position to a closed position. Door assembly 100 is generally mounted to a door frame 112 via a header assembly 114 comprised of a plurality of mounting plates 116. Self-closing door assembly 100 enables manual movement of sliding door 110 in the direction of arrow 120 towards an open position and, upon release of door 110, controls movement of door 110 in the direction of arrow 130 to return door 110 to the closed position such that it rests against door jamb 118. Embodiments provided herein enable door assembly 100 to fit within a low profile header assembly 114 for closing sliding door 110 at a constant speed, thereby allowing for a more secure and controlled operation of sliding door 110.

Figure 2A:
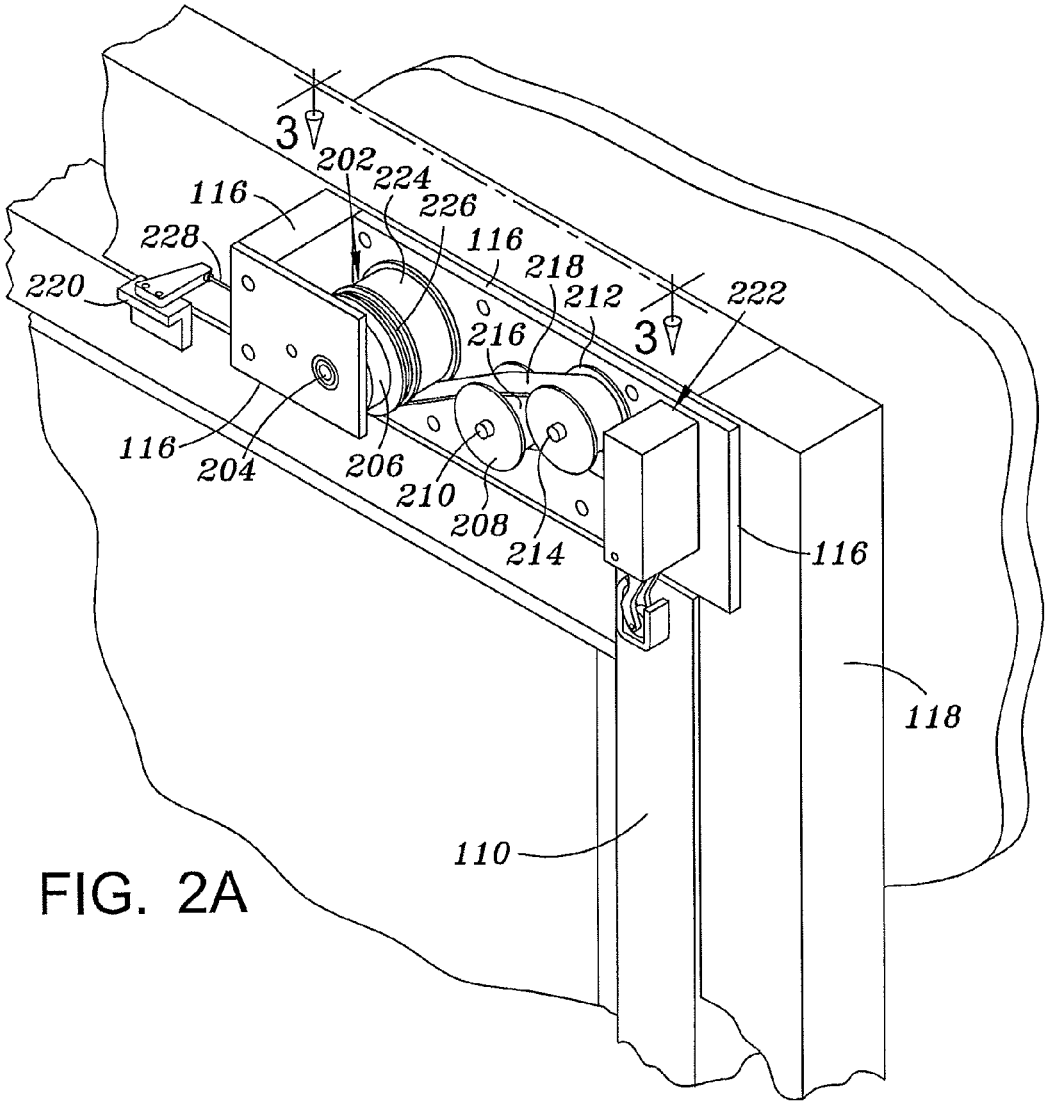
FIG. 2A illustrates a detailed view of the sliding door assembly of FIG. 1 in a closed position.
Figures 2B, 4:
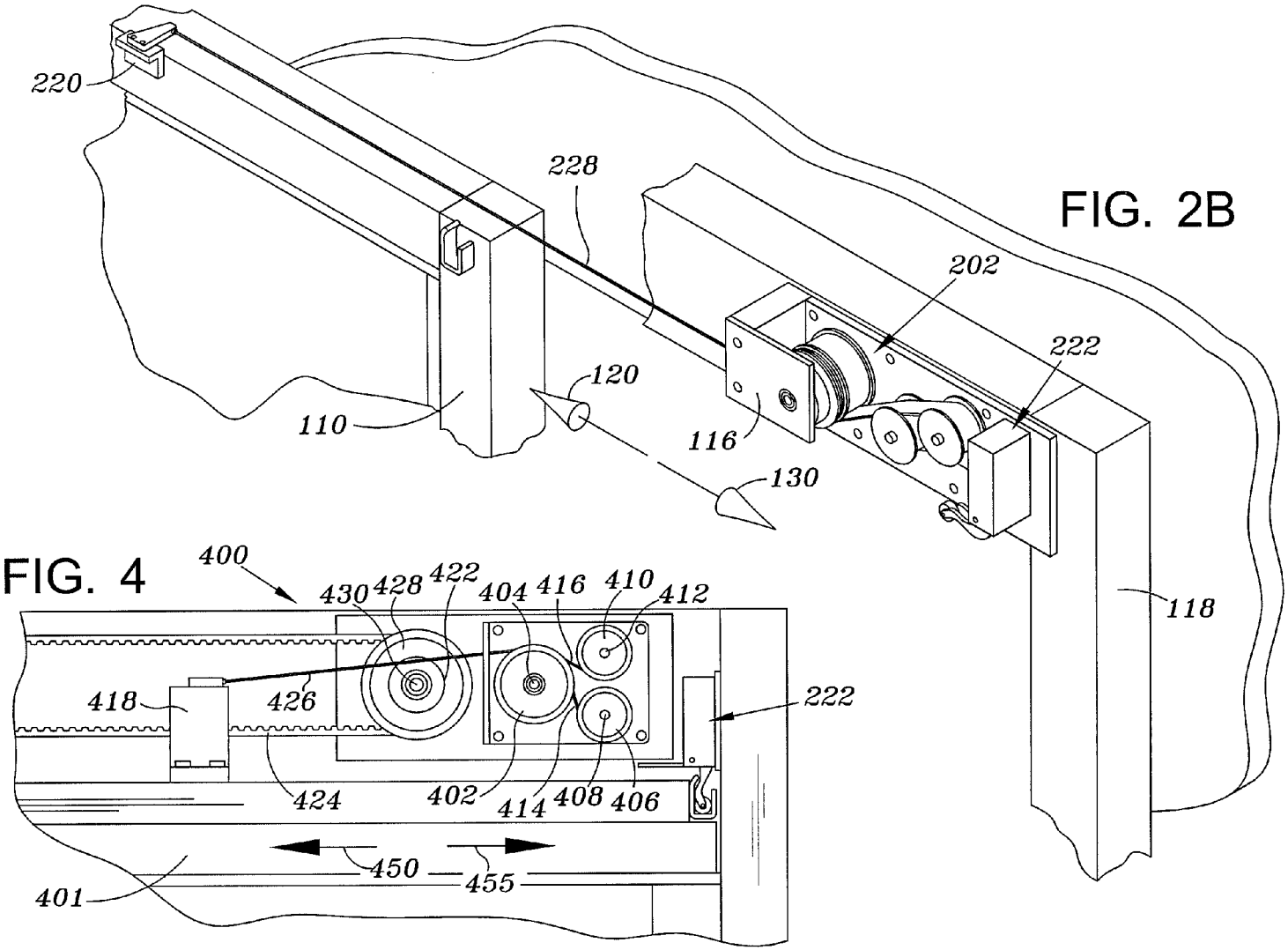
FIG. 2B illustrates a detailed view of the sliding door assembly of FIG. 1 in an open position.
FIG. 4 illustrates a detailed view of a second embodiment of the self-closing sliding door assembly.

Referring to FIGS. 1, 2A, and 2B, sliding door assembly 100 comprises a main spool 202 disposed on a shaft 204, a first storage spool 208 disposed on a second shaft 210 and a second storage spool 212 disposed on a shaft 214. A biasing member 216 is storable on spool 208 and coupled at one end to spool 202. A biasing member 218 is storable on storage spool 212, also being coupled to main spool 202 at one end. In FIGS. 2A and 2B, the biasing members 216 and 218 preferably comprise a metal spring biased in a wound position on the respective spools 208 and 212; however, it should be understood that biasing members 216 and 218 can be formed of any material having spring-like properties. As discussed in further detail below, when biasing members 216 and 218 are unwound from storage spools 208 and 212 and wound onto the main spool 202 (as a result of opening door 110), potential energy is stored in biasing members 216 and 218 to generate a door closing force. This closing force causes biasing members 216 and 218 to retract from and otherwise unwind and rotate main spool 202 until biasing members 216 and 218 are wound back onto respective spools 208 and 212. This action moves door 110 to the closed position. While FIGS. 1-2B illustrate storage spools 208 and 212, it should be understood that greater or fewer number of storage spools may be utilized, depending on the selected spring coefficient of biasing members 216 and 218, the weight of the door, the desired closing speed of door 110, size limitations of header assembly 14, and/or any other factor that contributes to the closing of door 110.

Figure 3:
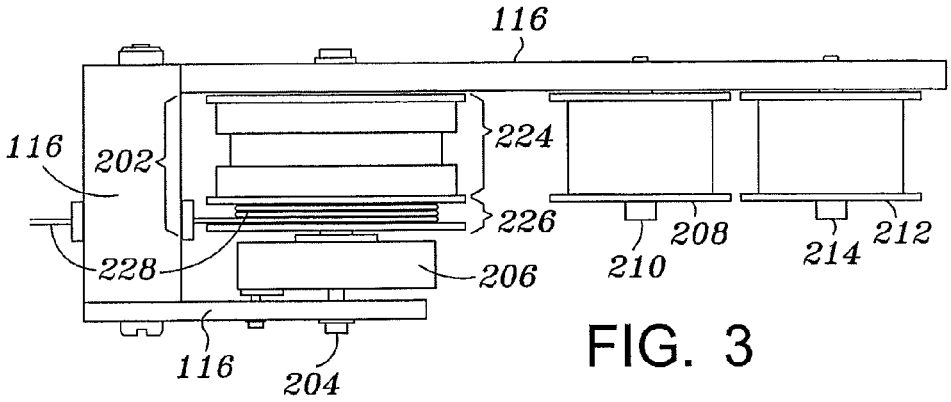
FIG. 3 illustrates a top view of a portion of the sliding door assembly of FIG. 1 taken along line 3-3 of FIG. 2A.

Referring to FIGS. 2A, 2B and 3, main spool 202 further includes an output spool portion 224 for winding first and second biasing members 216 and 218 thereon and a cable reel portion 226 for, as discussed in further detail below, winding a door cable 228 thereon. Door cable 228 extends from reel portion 226 and couples to a door plate 220, which is mounted on and movable with sliding door 110. In operation, movement of door 110 between the open and closed positions effects movement of door plate 220 thereby winding and unwinding cable 228 from cable reel portion 226.

While not illustrated, main spool 202 also utilizes a clutch bearing, which enables main spool 202 (including the output spool portion 224 and cable reel portion 226) to rotate freely about first shaft 204 in a clockwise direction during door opening without rotating the first shaft 204. However, when main spool 202 rotates in a counterclockwise direction during door closure (i.e. door movement in the direction of arrow 130), the clutch bearing engages shaft 204 causing it to rotate in a counterclockwise direction for reasons subsequently discussed. It should be understood by those of ordinary skill in the art that in some embodiments the clutch bearing may be interchanged with any other type of similar device such as, for example, a sprag clutch or one-way freewheel clutch.

When door 110 is in the closed position (FIG. 2A), biasing members 216 and 218 are at least partially wrapped around storage spools 208 and 212, respectively, and door cable 228 is wrapped around and stored on cable reel portion 226. As door 110 is moved in the direction of arrow 120 (FIG. 2B), door plate 220, which moves with sliding door 110, unwinds door cable 228 from and rotates reel portion 226 (and thus main spool 202) in a clockwise direction. During rotation, biasing members 216 and 218 are wound onto output spool portion 224 and store potential energy therein to create a sufficient closing force.

When releasing sliding door 110 from an open position, the potential energy rotates main spool 202 in a counterclockwise direction. In particular, the stored energy in biasing members 216 and 218 causes biasing members 216 and 218 to rotate and unwind from main spool 202 and return to storage spools 208 and 212, respectively. As main spool 202 rotates, cable 228 is wound onto cable reel portion 226 thereby pulling the door plate 220 (and thus door 110) in the direction of arrow 130, towards a closed position.

In order to avoid a door over-speed condition and/or to otherwise control the closing movement of door 110, sliding door assembly 100 also utilizes a damper/governor 206 (FIG. 3) disposed on and otherwise fixedly secured to first shaft 204. In operation, as main spool 202 rotates in the counterclockwise direction during door closure, the clutch bearing engages first shaft 204, causing shaft 204 to rotate counterclockwise with main spool 202. As shaft 204 rotates, damper 206 is rotated therewith to regulate and/or otherwise control the speed at which shaft 204 and main spool 202 rotate. In the embodiment illustrated herein, damper 206 comprises a viscous damper; however, it should be understood that any other type of speed control device/governor can be utilized for controlling the speed of shaft 204, and thus door 110.

Referring now to FIG. 4, an alternate self-closing sliding door assembly 400 is illustrated for controlling movement of a sliding door 401 from an open position to a closed position. As illustrated in FIG. 4, self-closing door assembly 400 comprises a main spool 402 rotatable about a shaft 404, a storage spool 406 rotatable about a shaft 408 and a second storage spool 410 rotatable about a third shaft 412. A first biasing member 414 is stored on spool 406 and comprises an end coupled to main spool 402. A second biasing member 416 is storable on storage spool 410 with an end coupled to main spool 402. In the embodiment illustrated in FIG. 4, biasing members 414 and 416 comprise a metal spring or other material biased in a wound position on the respective storage spools 406 and 410, as described above.

Similar to the embodiment illustrated in FIGS. 1-3, when sliding door 401 is released from an open position, potential energy stored within biasing members 414 and 416 rotate main spool 402 clockwise and unwind therefrom onto respective spools 406 and 410. As such, door cable 426 is wound onto a cable reel portion of main spool 402, thereby pulling door plate 418 (and thus door 401) in the direction of arrow 455 to effect movement of sliding door 401 towards a closed position. In the embodiment illustrated in FIG. 4, a belt 424 is coupled to, and movable with, door plate 418 and is trained around idler wheel 428 disposed on shaft 430 such that movement of door plate 418 (and thus door 401) in a first or second direction 450 or 455 effects movement of belt 424 and, thus, rotation of idler wheel 428 and shaft 430. Damper 422 is disposed on, and rotatable with, shaft 430. As shaft 430 rotates, damper 422 is rotated therewith to regulate and/or otherwise control the speed at which shaft 430 and idler wheel 428 rotate. Thus, as door 401 moves in the direction of arrow 455, damper 422 controls the speed at which belt 424 moves, thereby regulating the speed at which door 401 closes. In some embodiments, damper 422 or idler wheel 428 may utilize a clutch bearing similar to that discussed above, thereby enabling shaft 430 to rotate freely in a clockwise direction without engaging damper 422 as door 401 moves in the direction of arrow 450. Although damper 422 is disposed on shaft 430 in FIG. 4, it should be understood that in other embodiments, damper 422 may be disposed on a different shaft positioned at an end of belt 424 opposite idler wheel 428 and shaft 430.

Figure 5A:
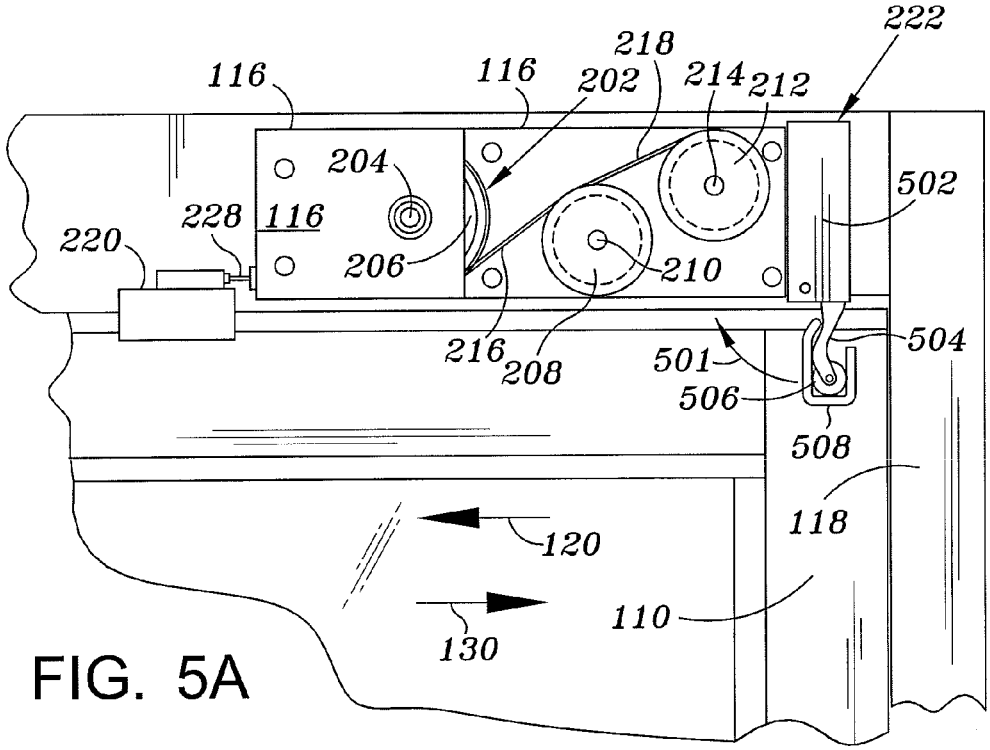
FIG. 5A illustrates a close-assist device in a fully-uncocked position when the sliding door is in the closed door position.
Figure 5B:
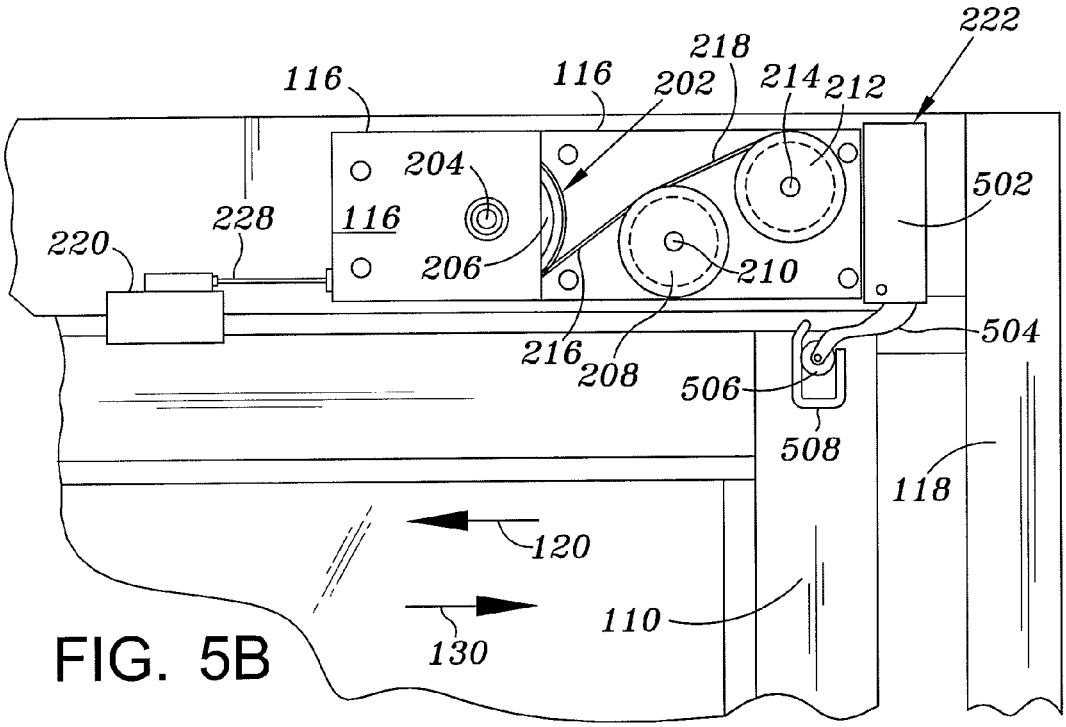
FIG. 5B illustrates the close-assist device of FIG. 5A in a first partially-cocked position when the sliding door is in a slightly open position.
Figure 5C:
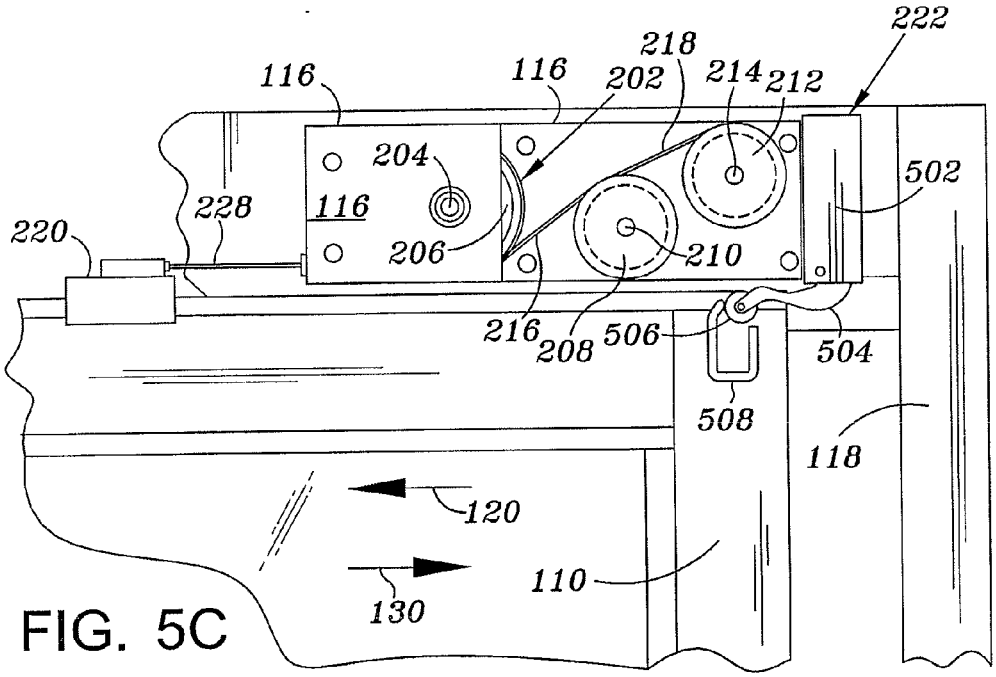
FIG. 5C illustrates the close-assist device of FIGS. 5A and 5B in a fully-cocked position.
Figure 5D:
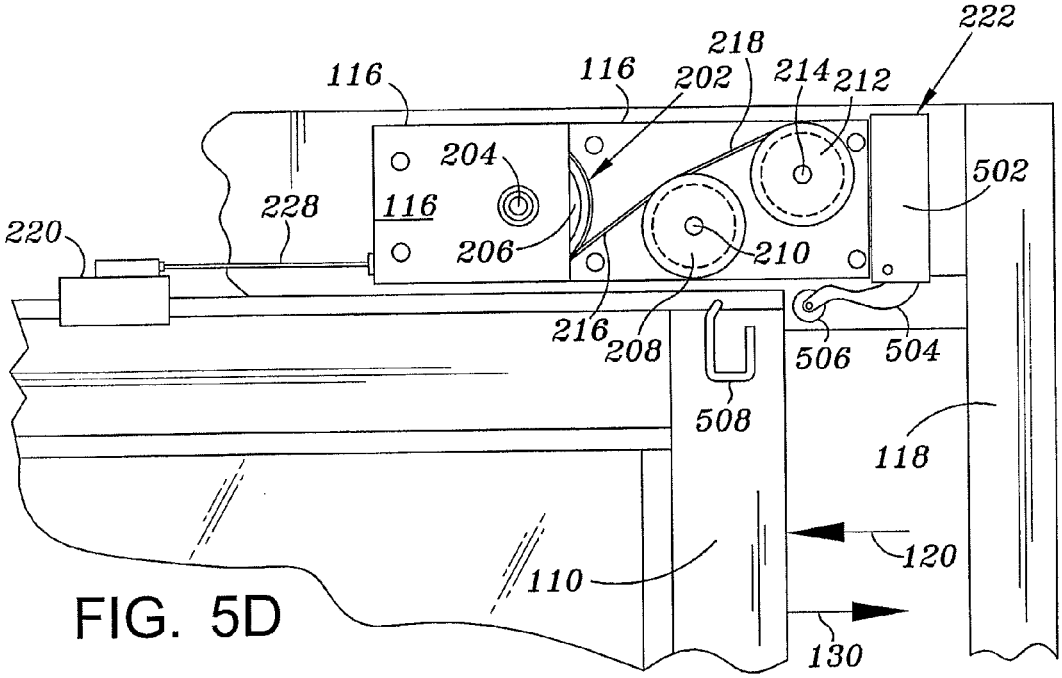
FIG. 5D illustrates the close-assist device of FIGS. 5A-5C in the fully-cocked position.

Referring to FIGS. 1, 2A-2B, 4 and 5A-5D, a close-assist device 222 is operable to engage door 110 in order to draw the door 110 to a closed position against door jamb 118. Close-assist device 222 substantially reduces or eliminates any bounce-back motion typically associated with conventional door-closing systems and ensures that door 110 is fully positioned in the closed position. Referring specifically to FIGS. 5A through 5D, close-assist device 222 is illustrated at various positions of operation. Close-assist device 222 comprises a body 502, arm 504, and wheel 506. A cradle 508 is mounted on door 110 and is positioned to engage and receive arm 504 and wheel 506. In operation, when door 110 moves in the direction of arrow 120 from a closed position towards an open position (see FIGS. 5A and 5B), arm 504 and wheel 506 are pushed and/or otherwise rotated in the direction of arrow 501 to disengage from cradle 508. In particular, as door 110 moves in the direction of arrow 120, arm 504 is pushed until arm 504 and wheel 506 are completely disengaged from cradle 508. Once arm 504 and wheel 506 are disengaged from the cradle 508, arm 504 is in a fully "cocked" position (see FIGS. 5C and 5D). As door 110 is moved in the direction of arrow 130 toward the closed position, the close-assist 222 engages cradle 508 with arm 504 and wheel 506 and actuates to pull door 110 against door jamb 118 to a closed position (FIG. 5A). Close-assist device 222 prevents and/or substantially eliminates door 110 from bumping into the door jamb 118, thereby reducing or eliminating the bounce-back motion typically associated with conventional door-closing systems. Furthermore, close-assist device 222 also ensures that door 110 is pulled to the fully closed position.

Various adaptations and alterations may be made to the various embodiments provided herein without departing from the spirit and scope of the present disclosure as set forth in the claims provided below. For example, although it is not illustrated, it should be appreciated that in some embodiments, the sliding door assembly 100 may comprise a single biasing member storable on a single storage spool and coupled to the main spool 202, such that when wound about main spool 202, the single biasing member is operable to store enough energy to exert sufficient closing force to move the sliding door to the closed position as explained herein. Additionally, in some embodiments, the cable reel portion 226 and output spool portion 224 of the main spool may be separate components instead of one integrated unit as disclosed herein. Furthermore, while embodiments described and illustrated herein provide for a self-closing sliding door assembly 100, it should be understood that assembly 100 can be configured for use as a self-opening door assembly such that instead of storing a sufficient level of potential energy to move the door to the closed position, biasing members 216, 218, 416 and/or 418 can be configured to store potential energy to move door 110 to the open position.

What is claimed is:

1. A self-closing sliding door header assembly secured to a door frame and operable to move a sliding door from an open position to a closed position, the header assembly comprising:

a main spool disposed on a first shaft for winding a door cable thereon, the door cable extending between the sliding door and the main spool;

a storage spool disposed on a second shaft;

a biasing member storable on the storage spool and coupled to the main spool;

a damper rotatably disposed on the first shaft to regulate movement of the main spool when the door is moving toward the closed position; and wherein in response to moving the door to the open position, the biasing member unwinds from the storage spool and wraps around the main spool thereby storing potential energy in the biasing member such that when the door is released, the stored energy exerts a closing force to move the door to the closed position.

2. The sliding door header assembly of claim 1, further comprising a second storage spool rotatable on a third shaft and having a second biasing member stored on the second storage spool and coupled to the main spool.

3. The sliding door header assembly of claim 2, wherein the second storage spool is disposed above the storage spool.

4. The sliding door header assembly of claim 3, wherein the storage spool is disposed between the second storage spool and the main spool.

5. The sliding door assembly of claim 3, wherein the second storage spool is vertically aligned with the storage spool.

6. The sliding door header assembly of claim 1, further comprising:

a cable spool disposed on the first shaft and movable with the main spool; and the door cable extending between the door and the cable spool, such that when the door is moved to the open position, the door cable unwinds from the cable spool to rotate the main spool in a first direction.

7. The sliding door header assembly of claim 6, further comprising:

a door plate coupled to the door and adapted to receive the door cable extending between the door and the cable spool such that when the main spool rotates in a second direction opposite the first direction, the door cable is wound onto the cable spool effecting movement of the door in the second direction.

8. The sliding door header assembly of claim 1, wherein the damper is a viscous damper.

9. The sliding door assembly of claim 1, further comprising:

a damper disposed on a third shaft; and a belt coupled to the door and moveable with the third shaft;

wherein the belt is further moveable with the door and the damper is operable to regulate movement of the third shaft to regulate movement of the door when traveling to the closed position.

10. The sliding door header assembly of claim 1, further comprising a close-assist device for engaging the door as the door moves to the closed position and pulling the door to the closed position.

11. A self-closing sliding door header assembly secured to a door frame and operable to control movement of a sliding door from a first position to a second position, the sliding door assembly comprising:

an output spool rotatably disposed on a first shaft;

a first storage spool disposed on a second shaft;

a second storage spool disposed on a third shaft above the first storage spool;

a first biasing member storable on said first storage spool and coupled to said output spool such that rotation of said output spool in a first direction winds said first biasing member from said first storage spool onto said output spool, such that said first biasing member stores an energy operable to generate a force to cause said output spool to rotate in a second direction opposite said first direction; and a second biasing member storable on said second storage spool and coupled to said output spool such that rotation of said output spool in a first direction winds said second biasing member from said second storage spool onto said output spool, such that said second biasing member stores an energy operable to generate a force to cause said output spool to rotate in a second direction opposite said first direction;

a cable reel rotatably disposed on said first shaft and moveable with said output spool in said first and second directions; and a cable extending from said cable reel to said door;

wherein said first biasing member causes rotation of said cable reel in said second direction to wind said cable onto said cable reel, thereby effecting movement of said door towards said second position.

12. The sliding door header assembly as set forth in claim 11, wherein said second biasing member causes rotation of said cable reel in said second direction to wind said cable onto said cable reel, thereby effecting movement of said door towards said second position.

13. The sliding door header assembly as set forth in claim 11, wherein said second storage spool is disposed between said first storage spool and said output spool.

14. The sliding door header assembly as set forth in claim 11, wherein said first storage spool is disposed between said second storage spool and said output spool.

15. The sliding door assembly as set forth in claim 14, wherein said second storage spool is vertically aligned with said first storage spool.

16. The sliding door header assembly as set forth in claim 11, wherein movement of said door from said second position to said first position effects rotation of said output spool in said first direction.

17. The sliding door header assembly as set forth in claim 11, wherein movement of said door from said second position to said first position unwinds said cable from said cable reel to rotate said cable reel in said first direction.

18. The sliding door header assembly as set forth in claim 11, wherein said output spool is operable to rotate freely about said first shaft in said first direction, and is further operable to rotate said first shaft in said second direction when said output spool rotates in said second direction.

19. The sliding door header assembly as set forth in claim 11, further comprising a damper disposed on said first shaft, said damper operable to regulate rotation of said first shaft to control the speed at which the door moves to said second position.

20. The sliding door assembly as set forth in claim 12, further comprising:

a damper disposed on a fourth shaft; and a belt coupled to the door and moveable with the fourth shaft;

wherein the belt is further moveable with the door and the damper is operable to regulate movement of the fourth shaft to control the speed at which the door moves to said second position.

* * * * *